US009066647B2

(12) United States Patent
Kappos

(10) Patent No.: US 9,066,647 B2
(45) Date of Patent: Jun. 30, 2015

(54) AIR INDUCTION HARD SURFACE CLEANING TOOLS WITH AN INTERNAL BAFFLE

(71) Applicant: Sapphire Scientific, Inc., Prescott, AZ (US)

(72) Inventor: Paul Kappos, Centerville, UT (US)

(73) Assignee: Dri-Eaz Products, Inc., Burlington, WA (US)

( * ) Notice: Subject to any disclaimer, the term of this patent is extended or adjusted under 35 U.S.C. 154(b) by 0 days.

(21) Appl. No.: 13/971,718

(22) Filed: Aug. 20, 2013

(65) Prior Publication Data

US 2014/0196243 A1 Jul. 17, 2014

Related U.S. Application Data

(63) Continuation of application No. 12/327,561, filed on Dec. 3, 2008, now Pat. No. 8,510,902.

(60) Provisional application No. 60/992,030, filed on Dec. 3, 2007.

(51) Int. Cl.
*A47L 11/30* (2006.01)
*A47L 11/40* (2006.01)
(Continued)

(52) U.S. Cl.
CPC ..... *A47L 11/302* (2013.01); *A47L 11/34* (2013.01); *A47L 11/4044* (2013.01); *A47L 11/4069* (2013.01); *A47L 11/4088* (2013.01); *B08B 3/024* (2013.01); *B08B 2203/0229* (2013.01)

(58) Field of Classification Search
CPC ... A47L 11/302; A47L 11/34; A47L 11/4069; A47L 11/4044; A47L 11/4088; B08B 2203/0229
USPC ..... 15/320, 387, 389, 345, 321, 300.1, 15/316.1, 400, 405, 372, 381, 383; 134/174, 175, 198, 199; 34/241
See application file for complete search history.

(56) References Cited

U.S. PATENT DOCUMENTS 855,433 A 5/1907 Freeman
896,290 A 8/1908 Freeman
(Continued)

FOREIGN PATENT DOCUMENTS

AU 656114 B3 1/1995
AU 6869694 1/1995
(Continued)

OTHER PUBLICATIONS

Definition of Fluid, Hyperdictionary, http://www.hyperdictionary.com/search.aspx?define=Fluid, accessed Aug. 11, 2011, 3 pages.
(Continued)

*Primary Examiner* — Lee D Wilson
*Assistant Examiner* — Tyrone V Hall, Jr.
(74) *Attorney, Agent, or Firm* — Perkins Coie LLP

(57) ABSTRACT

An apparatus for cleaning surfaces, particularly solid surfaces, includes an outer housing and an inner housing configured to substantially encapsulate a surface being cleaned, a vacuum source traversing the outer housing, a rotating coupler, an impeller, at least one fluid jet coupled to the impeller, and at least one air induction port. The vacuum source is configured to induce air through the air induction ports past the impeller blades causing the impeller to rotate, which causes the rotating coupler and the fluid jets to rotate. Because the rotation of the fluid jets is due to induced air, the fluid jets can be positioned at any angle desired, including a negative angle.

21 Claims, 7 Drawing Sheets

(51) Int. Cl.

| | |
|---|---|
| ***A47L 11/34*** | (2006.01) |
| ***B08B 3/02*** | (2006.01) |

(56) References Cited

U.S. PATENT DOCUMENTS

| | | | |
|---|---|---|---|
| 930,134 | A | 8/1909 | Blackall |
| 933,003 | A | 8/1909 | Smith |
| 1,016,435 | A | 2/1912 | Overholt |
| 1,042,711 | A | 10/1912 | Moorhead |
| 1,211,948 | A | 1/1917 | Koster et al. |
| 1,498,255 | A | 6/1924 | Winchester |
| 1,601,774 | A | 10/1926 | Scheffer |
| 1,661,553 | A | 3/1928 | Baar |
| 1,703,551 | A | 2/1929 | Singer |
| 1,821,715 | A | 9/1931 | Kuchinsky |
| 1,929,345 | A | 10/1933 | Brown et al. |
| 1,992,238 | A | 2/1935 | Rose |
| 2,000,930 | A | 5/1935 | De Nagy |
| 2,063,253 | A | 12/1936 | Kuhnel et al. |
| 2,081,597 | A | 5/1937 | Nowak |
| 2,156,890 | A | 5/1939 | Wuringer |
| 2,164,392 | A | 7/1939 | Ellis |
| 2,210,030 | A | 8/1940 | Ellis |
| 2,219,802 | A | 10/1940 | Bjorkman |
| 2,240,005 | A | 4/1941 | Moyer |
| 2,276,944 | A | 3/1942 | Dow |
| 2,280,751 | A | 4/1942 | Davis |
| 2,533,697 | A | 12/1950 | Stewart |
| 2,554,238 | A | 5/1951 | Burrl |
| 2,624,063 | A | 1/1953 | Van Der Heem |
| 2,703,905 | A | 3/1955 | Faith-Ell |
| 2,719,596 | A | 10/1955 | Kent et al. |
| 2,744,272 | A | 5/1956 | Theis et al. |
| 2,764,394 | A | 9/1956 | Miller |
| 2,785,432 | A | 3/1957 | Rockwell |
| 2,799,040 | A | 7/1957 | Hageal |
| 2,822,061 | A | 2/1958 | Pettit et al. |
| 2,904,817 | A | 9/1959 | Brennan et al. |
| 3,029,463 | A | 4/1962 | Bishop |
| 3,065,491 | A | 11/1962 | Amador |
| 3,072,951 | A | 1/1963 | Kelnhofer |
| 3,134,128 | A | 5/1964 | Campbell |
| 3,169,843 | A | 2/1965 | Campbell |
| 3,243,832 | A | 4/1966 | Allen et al. |
| 3,286,368 | A | 11/1966 | Thomas |
| 3,324,846 | A | 6/1967 | Smith |
| 3,345,672 | A | 10/1967 | La Mers et al. |
| 3,375,540 | A | 4/1968 | Hyde |
| 3,506,747 | A | 4/1970 | Creskoff |
| 3,571,841 | A | 3/1971 | Crouser |
| 3,605,171 | A | 9/1971 | Candor et al. |
| 3,619,848 | A | 11/1971 | Salzmann |
| 3,624,668 | A | 11/1971 | Krause |
| 3,689,956 | A | 9/1972 | Melreit |
| 3,697,771 | A | 10/1972 | Colt |
| 3,701,343 | A | 10/1972 | Bowers |
| 3,708,824 | A | 1/1973 | Holubinka |
| 3,739,422 | A | 6/1973 | Johnson et al. |
| 3,739,483 | A | 6/1973 | Meier-Windhorst |
| 3,761,997 | A | 10/1973 | Frazier |
| 3,771,193 | A | 11/1973 | Hageal |
| 3,774,261 | A | 11/1973 | Colt |
| 3,780,398 | A | 12/1973 | Candor |
| 3,786,531 | A | 1/1974 | Borg |
| 3,800,359 | A | 4/1974 | Howard et al. |
| 3,840,935 | A | 10/1974 | Fitzgerald, Jr. et al. |
| 3,849,823 | A | 11/1974 | Adamson et al. |
| 3,864,784 | A | 2/1975 | Kilstrom et al. |
| 3,895,407 | A | 7/1975 | Parise |
| 3,919,729 | A | 11/1975 | Cannan |
| 3,940,826 | A | 3/1976 | Phillips et al. |
| 3,950,815 | A | 4/1976 | Fukuchi et al. |
| 3,958,298 | A | 5/1976 | Cannan |
| 3,964,925 | A | 6/1976 | Burgoon |
| 4,000,538 | A | 1/1977 | Tissier |
| 4,013,039 | A | 3/1977 | Kubilius et al. |
| 4,014,347 | A | 3/1977 | Halleck et al. |
| 4,037,290 | A | 7/1977 | Rose et al. |
| 4,074,387 | A | 2/1978 | Arato et al. |
| 4,095,309 | A | 6/1978 | Sundheim |
| D248,763 | S | 8/1978 | Muller |
| 4,109,340 | A | 8/1978 | Bates |
| 4,133,072 | A | 1/1979 | Face, Jr. |
| 4,153,968 | A | 5/1979 | Perkins |
| 4,161,802 | A | 7/1979 | Knight et al. |
| 4,182,001 | A | 1/1980 | Krause |
| 4,203,714 | A | 5/1980 | Wenander |
| 4,207,649 | A | 6/1980 | Bates |
| 4,227,316 | A | 10/1980 | Schneider |
| 4,264,999 | A | 5/1981 | Monson |
| 4,270,238 | A | 6/1981 | Shallenberg et al. |
| 4,275,478 | A | 6/1981 | Kohlenberger |
| 4,279,057 | A | 7/1981 | Restivo |
| 4,284,127 | A | 8/1981 | Collier et al. |
| 4,308,636 | A | 1/1982 | Davis |
| 4,334,336 | A | 6/1982 | Harbeck et al. |
| 4,335,486 | A | 6/1982 | Kochte |
| 4,336,627 | A | 6/1982 | Bascus |
| 4,339,840 | A | 7/1982 | Monson |
| 4,373,226 | A | 2/1983 | Lubnitz |
| 4,377,018 | A | 3/1983 | Cain |
| 4,391,017 | A | 7/1983 | Bruensicke |
| 4,391,619 | A | 7/1983 | Shono et al. |
| 4,413,372 | A | 11/1983 | Berfield |
| 4,441,229 | A | 4/1984 | Monson |
| 4,443,909 | A | 4/1984 | Cameron |
| 4,464,810 | A | 8/1984 | Karpanty |
| 4,475,265 | A | 10/1984 | Berfield |
| 4,488,329 | A | 12/1984 | Lackenbach |
| 4,531,928 | A | 7/1985 | Ikenoya |
| 4,554,702 | A | 11/1985 | Kochte et al. |
| 4,571,849 | A | 2/1986 | Gardner et al. |
| 4,584,736 | A | 4/1986 | Gremminger |
| 4,675,935 | A | 6/1987 | Kasper et al. |
| 4,677,705 | A | 7/1987 | Schuster |
| 4,692,959 | A | 9/1987 | Monson |
| 4,731,956 | A | 3/1988 | Wood |
| 4,862,551 | A | 9/1989 | Martinez et al. |
| 4,875,249 | A | 10/1989 | Collier |
| 4,879,784 | A | 11/1989 | Shero |
| 4,922,572 | A | 5/1990 | Kohl et al. |
| 4,968,166 | A | 11/1990 | Ingram |
| 5,014,389 | A | 5/1991 | Ogilvie et al. |
| 5,032,184 | A | 7/1991 | Ogilvie et al. |
| 5,067,199 | A | 11/1991 | Alazet |
| 5,103,527 | A | 4/1992 | Holland |
| 5,134,748 | A | 8/1992 | Lynn |
| 5,280,666 | A | 1/1994 | Wood et al. |
| 5,312,044 | A | 5/1994 | Eaton |
| 5,392,490 | A | 2/1995 | Monson |
| 5,392,492 | A | 2/1995 | Fassauer et al. |
| D361,178 | S | 8/1995 | Piret |
| 5,437,651 | A | 8/1995 | Todd et al. |
| 5,463,791 | A | 11/1995 | Roden |
| 5,485,651 | A | 1/1996 | Payeur |
| 5,485,652 | A | 1/1996 | Holland |
| 5,548,905 | A | 8/1996 | Kuma et al. |
| 5,555,595 | A | 9/1996 | Ligman |
| 5,593,091 | A | 1/1997 | Harris |
| 5,634,238 | A | 6/1997 | McCaffrey et al. |
| 5,643,330 | A | 7/1997 | Holsheimer et al. |
| 5,655,255 | A | 8/1997 | Kelly |
| 5,655,258 | A | 8/1997 | Heintz |
| 5,659,923 | A | 8/1997 | Coombs |
| 5,706,549 | A | 1/1998 | Legatt et al. |
| 5,720,078 | A | 2/1998 | Heintz |
| 5,778,646 | A * | 7/1998 | Pfisterer ..... 56/16.4 R |
| 5,797,161 | A | 8/1998 | Campbell |
| 5,819,366 | A | 10/1998 | Edin |
| 5,867,864 | A | 2/1999 | Miller et al. |
| 5,870,797 | A | 2/1999 | Anderson |
| 5,891,198 | A | 4/1999 | Pearlstein |
| 5,911,260 | A | 6/1999 | Suzuki |
| 5,970,574 | A | 10/1999 | Thrash, Jr. |

(56) References Cited

U.S. PATENT DOCUMENTS

| | | | | |
|---|---|---|---|---|
| 5,992,051 | A | 11/1999 | Salehibakhsh | |
| 5,995,872 | A | 11/1999 | Bourgeois | |
| 6,013,227 | A | 1/2000 | Lin et al. | |
| 6,029,310 | A | 2/2000 | Besel | |
| 6,047,437 | A | 4/2000 | Suzuki | |
| 6,052,861 | A | 4/2000 | Keller | |
| 6,076,597 | A | 6/2000 | Manning et al. | |
| 6,080,243 | A | 6/2000 | Insley et al. | |
| 6,136,098 | A | 10/2000 | Tribastone | |
| 6,151,748 | A | 11/2000 | Earhart, Jr. et al. | |
| 6,151,784 | A | 11/2000 | Maruyama | |
| 6,152,151 | A | 11/2000 | Bolden et al. | |
| 6,195,907 | B1 | 3/2001 | Bodnar et al. | |
| 6,243,914 | B1 | 6/2001 | Studebaker | |
| 6,266,892 | B1 | 7/2001 | Haynie | |
| 6,298,577 | B1 | 10/2001 | Haynie | |
| 6,355,112 | B1 | 3/2002 | Bartholmey et al. | |
| 6,370,728 | B1 | 4/2002 | Burns | |
| 6,413,323 | B2 | 7/2002 | Shook et al. | |
| 6,513,192 | B1 | 2/2003 | Pearlstein | |
| 6,647,639 | B1 | 11/2003 | Storrer | |
| 6,675,437 | B1 | 1/2004 | York | |
| 6,981,338 | B2 | 1/2006 | Jensen et al. | |
| 7,059,013 | B2 | 6/2006 | Wydra et al. | |
| 7,070,662 | B2 | 7/2006 | Studebaker | |
| 7,159,271 | B2 | 1/2007 | Sepke et al. | |
| 7,392,566 | B2 | 7/2008 | Gordon et al. | |
| 7,624,474 | B1 | 12/2009 | Cho | |
| 7,870,639 | B2 | 1/2011 | Thomas | |
| 7,962,995 | B2 | 6/2011 | Allaway | |
| 8,453,293 | B1 | 6/2013 | Monson | |
| 8,510,902 | B2 | 8/2013 | Kappos | |
| 2004/0255484 | A1 | 12/2004 | Storrer et al. | |
| 2005/0144751 | A1 | 7/2005 | Kegg et al. | |
| 2006/0196074 | A1 | 9/2006 | Vilhunen | |
| 2007/0039724 | A1 | 2/2007 | Trumbower et al. | |
| 2007/0061996 | A1 | 3/2007 | Boone | |
| 2007/0079472 | A1* | 4/2007 | Carter et al. | 15/345 |
| 2007/0113368 | A1 | 5/2007 | Alexander | |
| 2007/0226943 | A1 | 10/2007 | Lenkiewicz et al. | |
| 2008/0184520 | A1 | 8/2008 | Wolfe et al. | |
| 2009/0038105 | A1 | 2/2009 | Mayer | |
| 2009/0094784 | A1 | 4/2009 | Pedlar et al. | |
| 2009/0139046 | A1 | 6/2009 | Kappos | |
| 2009/0288685 | A1 | 11/2009 | Wolfe et al. | |
| 2012/0151708 | A1 | 6/2012 | Carter et al. | |
| 2012/0233804 | A1 | 9/2012 | Studebaker et al. | |
| 2014/0115816 | A1 | 5/2014 | Bruders et al. | |
| 2014/0137895 | A1 | 5/2014 | Bruders et al. | |

FOREIGN PATENT DOCUMENTS

| | | | |
|---|---|---|---|
| AU | 1471595 | A | 7/1995 |
| AU | 664947 | B2 | 12/1995 |
| AU | 736546 | B2 | 8/2001 |
| AU | 199923942 | B2 | 8/2001 |
| CA | 02559485 | A1 | 9/2005 |
| CA | 02568203 | A1 | 12/2005 |
| GB | 663211 | A | 12/1951 |
| GB | 2145620 | A | 4/1985 |
| WO | WO-0106188 | A1 | 1/2001 |
| WO | WO-2005118959 | A1 | 12/2005 |

OTHER PUBLICATIONS

Dri-Eaz, "Rescue Mat System," <http://www.dri-eaz.com/VTC/RescueMat.html>, internet accessed on Jun. 20, 2005, 7 pages.

Injectidry Systems, Inc., "Product Page," <http://web.archive.org/web/20000520132110/www.injectidry.com/product.htm>, internet accessed on May 20, 2005, 3 pages.

Injectidry Systems, Inc., "Vac-It Panels," <http://web.archive.org/web/20021222211319/www.injectidry.com/vpanel.htm>, internet accessed on Jun. 20, 2005, 2 pages.

JonDon, "DryPro Water Vac", <http://www.jondon.com>, internet accessed on Apr. 2, 2010, 2 pages.

WaterClaw, "FlashXtractor," product brochure, undated, 2 pages.

* cited by examiner

AIR INDUCTION HARD SURFACE CLEANING TOOLS WITH AN INTERNAL BAFFLE

RELATED APPLICATIONS

This application is a continuation of U.S. patent application Ser. No. 12/327,561, filed Dec. 3, 2008, which is titled "Air Induction Hard Surface Cleaning Tools with an Internal Baffle," which claims the benefit under 35 U.S.C. §119(e) of U.S. Provisional Patent Application No. 60/992,030, filed Dec. 3, 2007 which is titled "Air Induction Hard Surface Cleaning Tools with an Internal Baffle." The above mentioned applications are incorporated herein by reference in its entirety.

TECHNICAL FIELD

The present system and method relate to hard surface cleaning apparatuses. More specifically, the present system and method relate to cleaning apparatuses having rotating cleaning heads.

BACKGROUND

Hard surface cleaning apparatuses vary in both shape and design. However, many traditional solid surface cleaning apparatuses include a water source that provides water and cleaning agents to high-pressure jets. The high-pressure jets impart a force on the surface, dislodging unwanted debris and material.

Many solid surface cleaning apparatuses include a rotating jet system. According to these traditional systems, one or more jets are positioned at the end of an arm or series of arms. The arms are coupled to a rotating coupler, which allows the arms to spin relative to the rest of the apparatus. According to many traditional systems, the high-pressure jets at the end of the arms are placed at extreme angles relative to the surface being cleaned. In this position, they impart a horizontal force component on the arms, thereby inducing rotation of the arms about the rotating coupler. However, traditional apparatuses are often unable to clean recessed areas on solid surfaces and fail to provide satisfactory cleaning swaths. The inability to clean recessed areas on solid surfaces is partially attributed to the high angle of the pressure jets. Many commercially used cleaning processes employ vacuum and high velocity water streams to dislodge and remove debris. A more efficient apparatus will fulfill a long felt need within the industry.

Specifically, it is often necessary to utilize lower pressures to prevent damage to more delicate surfaces. When traditional systems are used at low pressures, the jets fail to produce the rotation necessary for efficient cleaning. In addition, the extreme angles of the pressure jets are not ideal for dislodging debris. Consequently, the low pressure and extreme angle of the water stream results in inadequate cleaning at low pressures. They are therefore unable to clean delicate surfaces adequately.

Furthermore, traditional systems often incorporate a vacuum system designed to remove and capture dislodged debris and/or soiled water. In general, there is little or no means for controlling the airflow within the housing and across the surface being cleaned. Consequently these prior devices result in ponding of the water on the work surface under the housing. Ponding occurs when the suction throughout the housing is insufficient or misdirected. The water from the high-pressure jets as well as the dislodged debris gathers in pools, often in the center of the apparatus or on an edge where suction is inadequate. Ponding results in less than satisfactory swaths.

The hard surface cleaning industry would greatly benefit from an improved cleaning apparatus that overcomes the shortcomings discussed above. The present invention provides such and apparatus.

SUMMARY

According to one exemplary embodiment, an apparatus for cleaning solid surfaces includes a housing configured to substantially encapsulate a surface being cleaned, a vacuum port traversing the housing, a rotating coupler assembly rotatably secured to the housing, an impeller coupled to the rotating coupler, at least one fluid jet coupled to the impeller, and at least one air pathway configured to allow induced air to pass by the impeller blades to rotatably drive them.

According to one exemplary embodiment, the at least one air pathway includes a plurality of air induction ports formed in the housing adjacent to the impeller, wherein the air induced from the plurality of air induction ports is configured to rotate the impeller, thereby rotating the rotating coupler.

According to one alternative embodiment, the at least one air pathway includes a water and/or air pickup path leading to a system vacuum hose. The use of air to drive the rotation of the rotating coupler allows for a more perpendicular fluid jet angle, which improves surface cleaning at lower pressures. In particular, the fluid jets may be positioned at a negative angle relative to the surface and the direction of rotation.

According to several embodiments, the present system incorporates interior baffles. The baffles are configured to direct and guide the airflow within the apparatus. According to various embodiments, the baffles, increase the flow of air across the impeller, reduce drying times, reduce ponding, and force air onto the surface being cleaned.

BRIEF DESCRIPTION OF THE DRAWINGS

The accompanying drawings illustrate various embodiments of the present system and method and are a part of the specification. The illustrated embodiments are merely examples of the present apparatus and method and do not limit the scope thereof.

Figure 1:
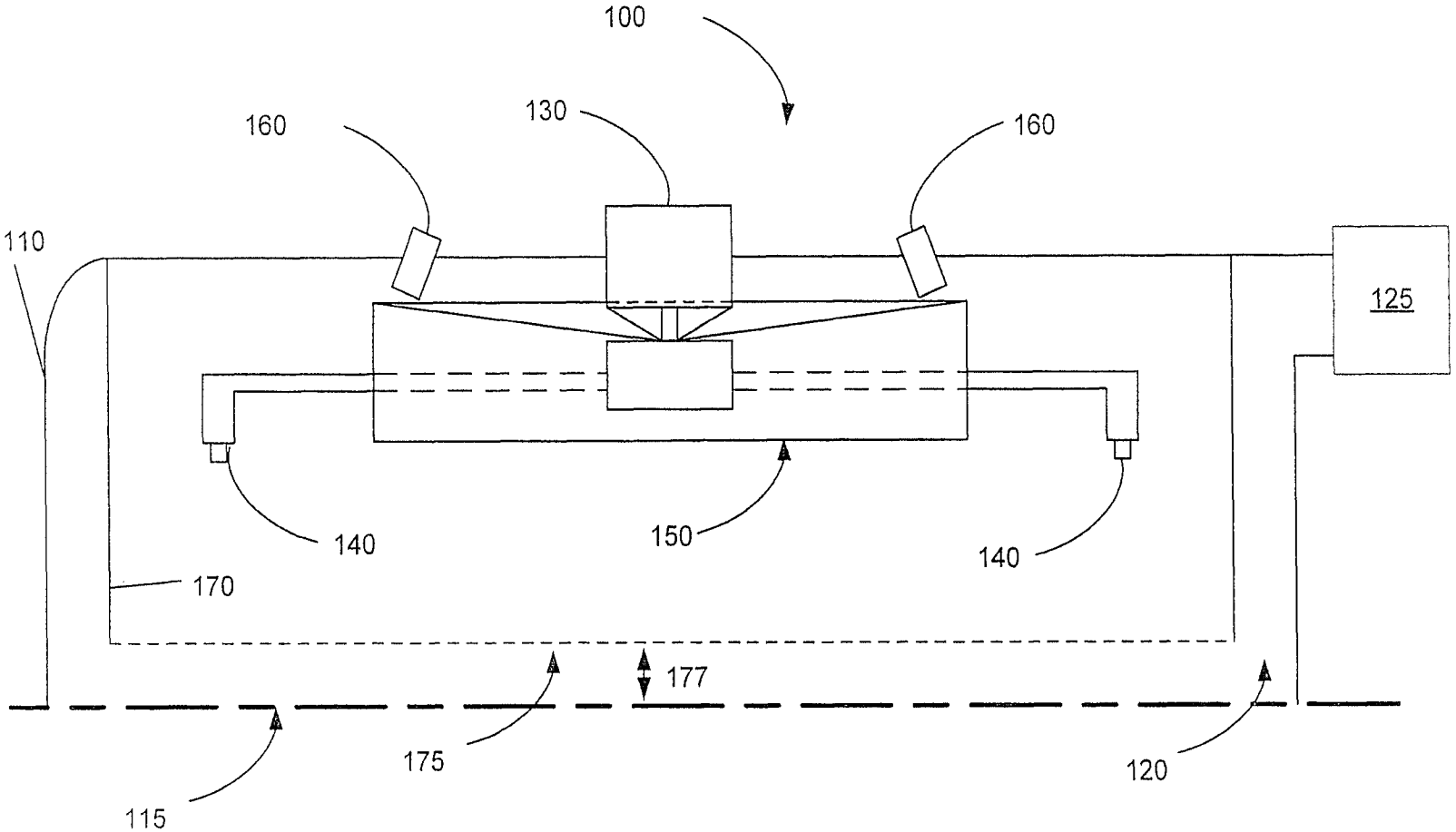
FIG. 1 illustrates a cross-sectional view of the present solid surface cleaning apparatus, including multiple air induction ports, according to one exemplary embodiment.

Throughout the drawings, identical reference numbers identify similar elements or features. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

An air driven solid surface cleaning apparatus is disclosed herein, according to various exemplary embodiments. Specifically, one exemplary apparatus includes an air induction pathway, one or more air induction ports in its housing, and an impeller secured to a rotating coupler assembly. Induced air imparts a rotational force on the fluid jet assembly, allowing for a more perpendicular fluid jet angle and improved surface cleaning at lower pressures. Similarly, according to one alternative embodiment, the apparatus includes an impeller assembly within an air return pathway. Embodiments and examples of the present exemplary systems and methods are described in detail below.

Unless otherwise indicated, all numbers expressing quantities, measurements, and so forth used in the specification and claims are to be understood as being modified in all instances by the term "about." Accordingly, unless indicated to the contrary, the numerical parameters set forth in the following specification and attached claims are approximations that may be modified and configured for specific application. Specifically, the angles of air induction ports and water injection mechanisms may be modified to increase efficiency as necessary.

In the following description, for purposes of explanation, numerous specific details are set forth in order to provide a thorough understanding of the present system and method. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Unless the context requires otherwise, throughout the specification and claims which follow, the word "comprise" and variations thereof, such as, "comprises" and "comprising" are to be construed in an open, inclusive sense, that is as "including, but not limited to."

The following description is presented to illustrate and describe several embodiments of the present exemplary system and method; it is not intended to limit the system and method to any exact form disclosed in conjunction with the various embodiments.

Several exemplary apparatuses utilizing induced air are described herein. According to one embodiment, induced air drives the rotation of both an impeller and one or more fluid jets; wherein the fluid jets are positioned at an angle nearly tangential to the surface. Subsequently, a description of an apparatus utilizing a vacuum to rotationally drive an impeller by pulling soiled water and air from the floor through the impeller is provided. Finally, modifications of these embodiments are provided wherein baffles are incorporated to direct airflow within the apparatuses. Various modifications of each of the above embodiments are described in detail. Specifically, various orientations of the fluid jets are discussed in conjunction with each of the exemplary embodiments.

Exemplary System

As illustrated in FIG. 1, according to one exemplary embodiment, a hard surface cleaning apparatus (100) comprises an inner housing (170) and an outer housing (110). The inner housing (170) defines a cleaning area and is slightly raised above the floor. The outer housing (110) contacts, or nearly contacts, the floor, while the inner housing (170) is raised up. This difference in height (177) between the floor (115) and the lower boundary (175) of the inner housing (170) may vary depending on the amount of desired airflow. The space located between the outer housing (110) and the inner housing (170) forms a vacuum space (120). A vacuum source (125) is connected to the vacuum space (120) and creates a vacuum, drawing excess water and dislodged debris from the surface being cleaned.

Additionally, as illustrated in FIG. 1, fluid jets (140) are rotatably connected to a rotating coupler (130). According to one exemplary embodiment, a pressurized water source (not shown) supplies pressurized water or cleaning solvents to the fluid jets (140). The pressurized water source causes the fluid jets (140) to impart a high-pressure stream of water or cleaning solution onto the section of the floor (115) within the bounds of the inner housing (170).

In contrast to the traditional apparatuses, which include many of the components described above, the present exemplary surface cleaning apparatus (100) also incorporates an impeller (150) attached to the rotating coupler (130). According to the exemplary embodiment illustrated in FIG. 1, the blades of the impeller are disposed near the top of the apparatus, but within the inner housing (170). The impeller (150) may be coupled to the rotating coupler (130) by any number of coupling means, including, but not limited to, an adhesive, welding, screws, bolts, mechanical fasteners, and other fastening means common in the art.

According to one embodiment of the present system and method, one or more air induction ports (160) are positioned above the impeller (150). The air induction ports (160), according to one exemplary embodiment, extend through the outer housing (110) of the apparatus (100).

According to one exemplary embodiment described in detail below, the inclusion and placement of air induction ports (160) in the outer housing (110) of the cleaning apparatus (100) allows induced air to drive the impeller (150). The vacuum source (125) creates suction within the vacuum space (120); this vacuum induces air through the air induction ports. The air passing through the air induction ports causes the impeller (150) to rotate, which in turn causes the rotating coupler (130) to rotate. The fluid jets (140) are directly coupled to the rotating coupler; consequently, if the rotating coupler rotates, they also rotate. Thus, the induced air causes the fluid jets (140) to rotate.

Prior art systems include fluid jets configured to produce the rotational force. In the prior art, fluid jets are positioned at a relatively high angle in order to create a sufficient horizontal force to drive the rotating arm. In the present exemplary cleaning apparatus (100), induced air, through the impeller and rotating coupler, rotatably drives the fluid jets (140). Consequently, the fluid jets (140) may be positioned at angles more efficient for cleaning.

Specifically, as previously mentioned, traditional spinning surface cleaners orient fluid jets at an extreme angle to provide the rotational force necessary. The extreme angles necessary in the prior art result in an overall less efficient cleaning system. However, due to the placement and positioning of the air induction ports (160) and the air driven impeller (150) in the present exemplary apparatus (100), rotational force derived from the fluid jets (140) is unnecessary. Consequently, the fluid jets (140) of the present exemplary cleaning apparatus (100) can be oriented to provide enhanced agitation for cleaning, as opposed to providing rotational force. Specifically, the fluid jets (140) of the present apparatus may be oriented, according to one exemplary embodiment, at between approximately 80 and 90 degrees relative to the surface (115). Water streams impacting the floor (115) tangentially, or nearly tangentially, dislodge debris more efficiently then the extreme angle of impact utilized in the prior art.

Figure 2:
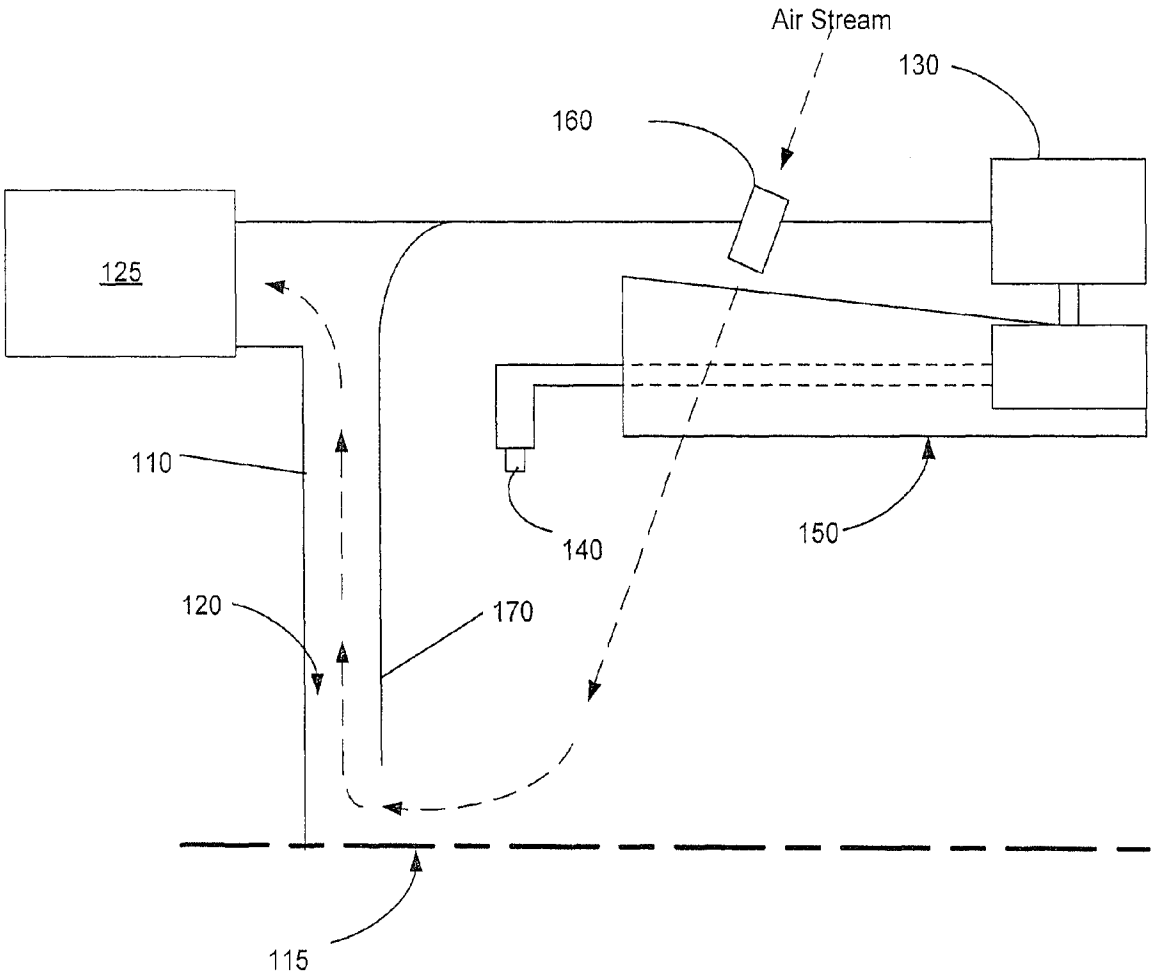
FIG. 2 illustrates a partial cross sectional view of the present solid surface cleaning apparatus, including an air induction port and air stream path, according to one exemplary embodiment.

FIG. 2 shows a partial cross sectional view of the hard surface cleaning apparatus (100), according to one exemplary embodiment. FIG. 2 illustrates the air stream induced by the vacuum source (125) driving the impeller (150), causing it to rotate at a high speed about the rotating coupler (130). Furthermore, FIG. 2 illustrates the air stream produced by the air induction ports (160) passing through the apparatus and into the vacuum source (125).

According to one exemplary embodiment, the outer housing (110) creates a substantial seal around a section of the floor (115). The vacuum source (125) creates a vacuum in the vacuum space (120) between the inner housing (170) and the outer housing (110). This vacuum causes air to flow from the outside of the cleaning apparatus (100) through the air induction ports (160), past the impeller (150), down the bottom of the inner housing (110), into the vacuum space (120), and finally into the vacuum source (125). The air stream (labeled 'Air Stream') is illustrated as a dashed line in FIG. 2. Initially, the vacuum source (125) induces an air stream through the air induction ports (160) and causes it to flow throughout the apparatus. The air stream causes the impeller (150) to rotate at a high velocity. According to one exemplary embodiment, the fluid jets (140) are coupled directly to the impeller (150). When the impeller (150) rotates, the fluid jets will also rotate at a high velocity. While rotating, high pressure water or cleaning solution may be applied to the floor (115) via the fluid jets (140). The vacuum source (125) and the high pressure fluid source(s) may be derived from any number of sources, including but not limited to, a portable machine, a truck mounted machine, or other similar apparatus capable of driving cleaning tools.

According to one exemplary embodiment, the vacuum created by the vacuum source (125) induces air through the air induction ports (160). As the air stream passes the impeller (150), a force is imparted on the surface of the blades of the impeller (150), causing the impeller to spin. As the impeller (150) rotates, a rotating coupler (130) begins to spin. As the rotating coupler (130) rotates, coupled fluid jets (140) will also rotate at a high velocity.

According to an alternative embodiment, the rotational propulsion created by the induced air is supplemental to an already existing force created by the high-pressure water stream emitted from the fluid jets (140). According to another exemplary embodiment, the use of induced air to provide the rotational propulsion allows the fluid jets (140) to be positioned at an angle closer to 90° than in the prior art. According to one embodiment, the fluid jets (140) are positioned at an angle slightly less than 90° in the direction of rotation. This "negative" angle allows lower pressures to be used for the cleaning and rinsing solutions, while still effectively cleaning the surface. Lower pressures are especially desirable when cleaning delicate surfaces, as they will significantly reduce the risk of damaging the surface.

Figure 3:
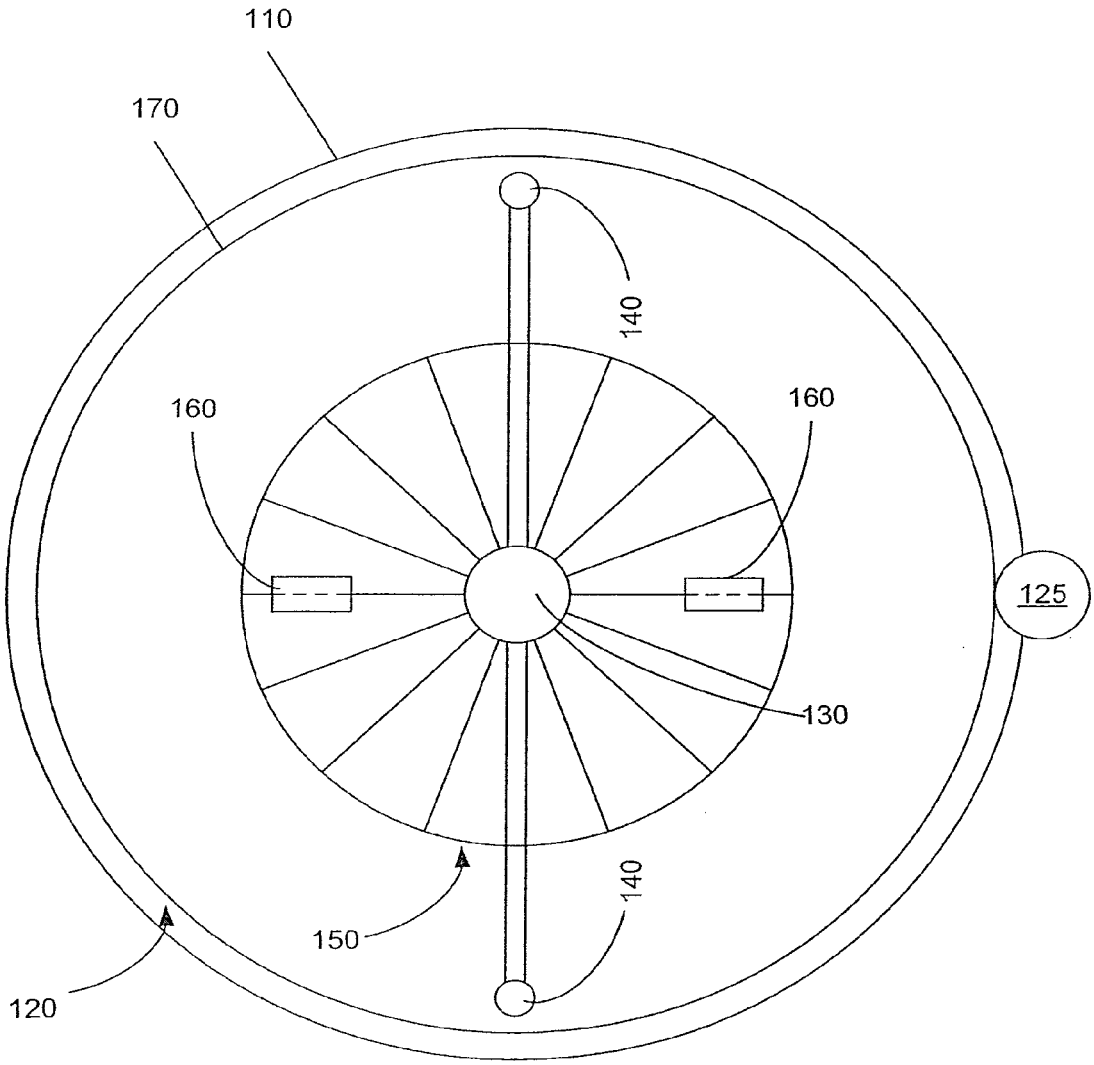
FIG. 3 illustrates a bottom view of the present solid surface cleaning apparatus, according to one exemplary embodiment.

FIG. 3 provides a bottom view of the present system and method, according to one exemplary embodiment. FIG. 3 illustrates the outer housing (110) and the inner housing (170). The vacuum space (120) is clearly illustrated as a ring of space between the inner (170) and outer (110) housings. A vacuum source (125) creates a vacuum within the vacuum space (120). The impeller (150) is positioned at the center of the apparatus, along with the rotating coupler (130) and the attached fluid jets (140). FIG. 3 illustrates the apparatus, according to one exemplary embodiment, as substantially circular. According to alternative embodiments, the outer and inner housing are of various shapes, such as rectangular, square, or oval. According to one embodiment, the outer and inner housings create and apparatus of an alternative shape, while the impeller (150) and fluid jets (140) continue to follow a circular rotation pattern.

Figure 4A:
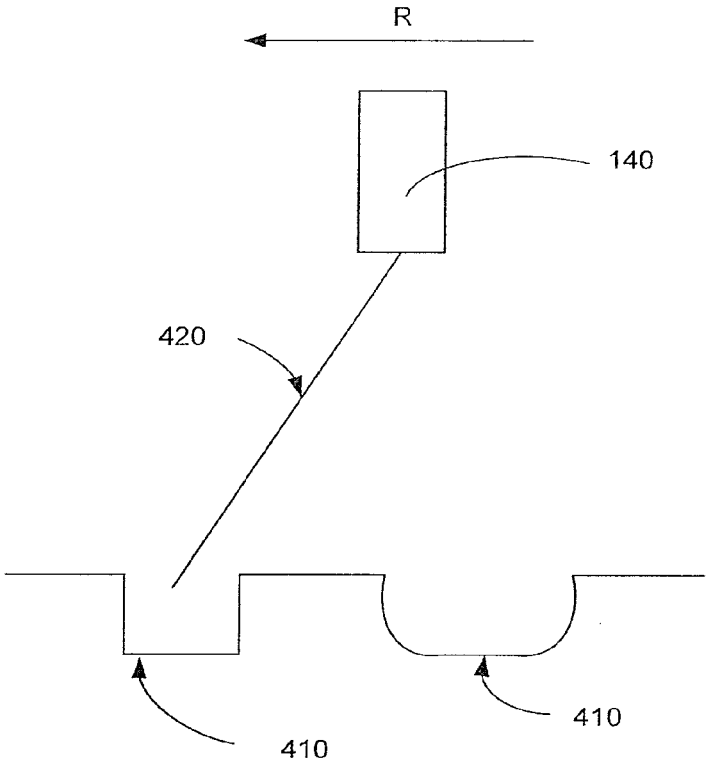
FIGS. 4A and 4B illustrate various fluid jet angle interactions with recessed surface imperfections, according to various exemplary embodiments.

FIG. 4A illustrates a fluid jet (140) and the water stream (420) emitted from it. According to one exemplary embodiment, each fluid jet (140) emits only one stream of water (420) against the angle of rotation. That is, the emitted stream of water (420) is in the same direction as the direction of rotation. This negatively angled water stream (420) provides several advantages over the prior art. Because prior art systems utilize the high-pressure water emitted from the fluid jets to drive the rotation of the system, a negative angle is not feasible—it would cause the apparatus to rotate in the opposite direction. In the present system and method, according to various exemplary embodiments, the rotation of the fluid jets (140) is caused by induced air. Consequently, the fluid jets (140) can be positioned at a negative angle. That is, they emit a leading edge stream of water (420) toward the direction of rotation. This leading edge provides superior cleaning and detailing of intricate cracks and grooves (410). Particularly, the leading edge (420) of the spray, pointed at a negative angle relative to the direction of rotation, provides better overall coverage of the fissures and pits in the surface being cleaned.

Figure 4B:
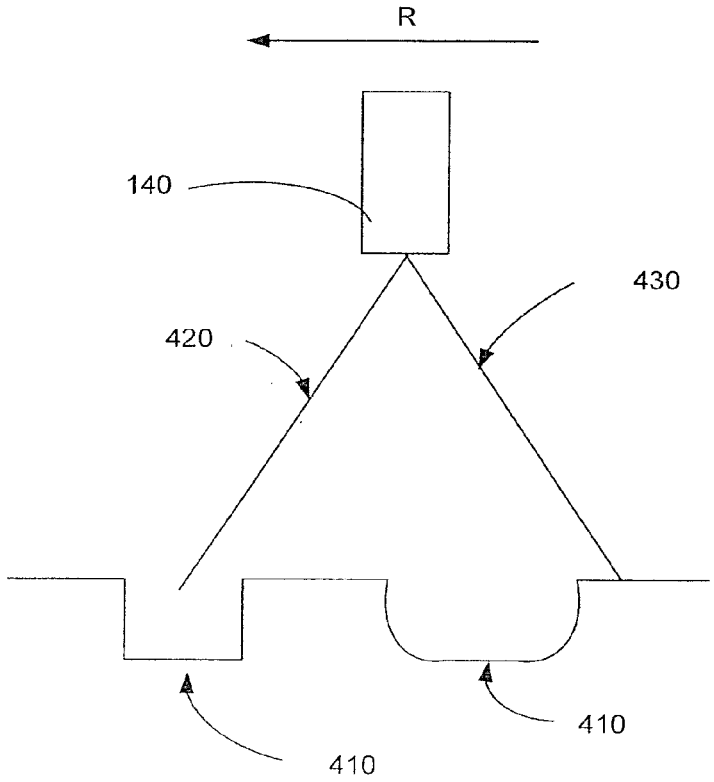

According to an alternative embodiment, illustrated in FIG. 4B, each fluid jet (140) emits two streams of water, one at a negative angle (420) and another at a positive angle (430). According to this embodiment, all of the attendant advantages of a negative angle described above are realized as well as any advantages associated with traditional positive angles. Furthermore, alternative embodiments include additional water streams at various angles. A significant advantage of the present system and method is the ability to angle several fluid jets (140) at any angle desired. Because the present system and method, according to various embodiments, do not rely on the high-pressure fluid jets to create the rotational propulsion, the fluid jets can be configured to provide optimal cleaning. In sum, the freedom to position the fluid jets (160) at various angles provides a significant advantage over the prior art.

Moreover, the introduction of air via the air induction ports (160) provides positive air induction on the surface being cleaned. After the air stream (see FIG. 2) enters the inner housing (170, FIG. 2) the air will pass over the surface being cleaned. Consequently, the present exemplary system completes drying times more quickly than prior art apparatuses. Furthermore, prior art apparatuses require vacuum relief ports to prevent the apparatus from becoming suctioned to the surface being cleaned. In the present system and method, according to various embodiments, the air induction ports (160) negate the need for the vacuum relief ports required in the prior art.

Figure 5:
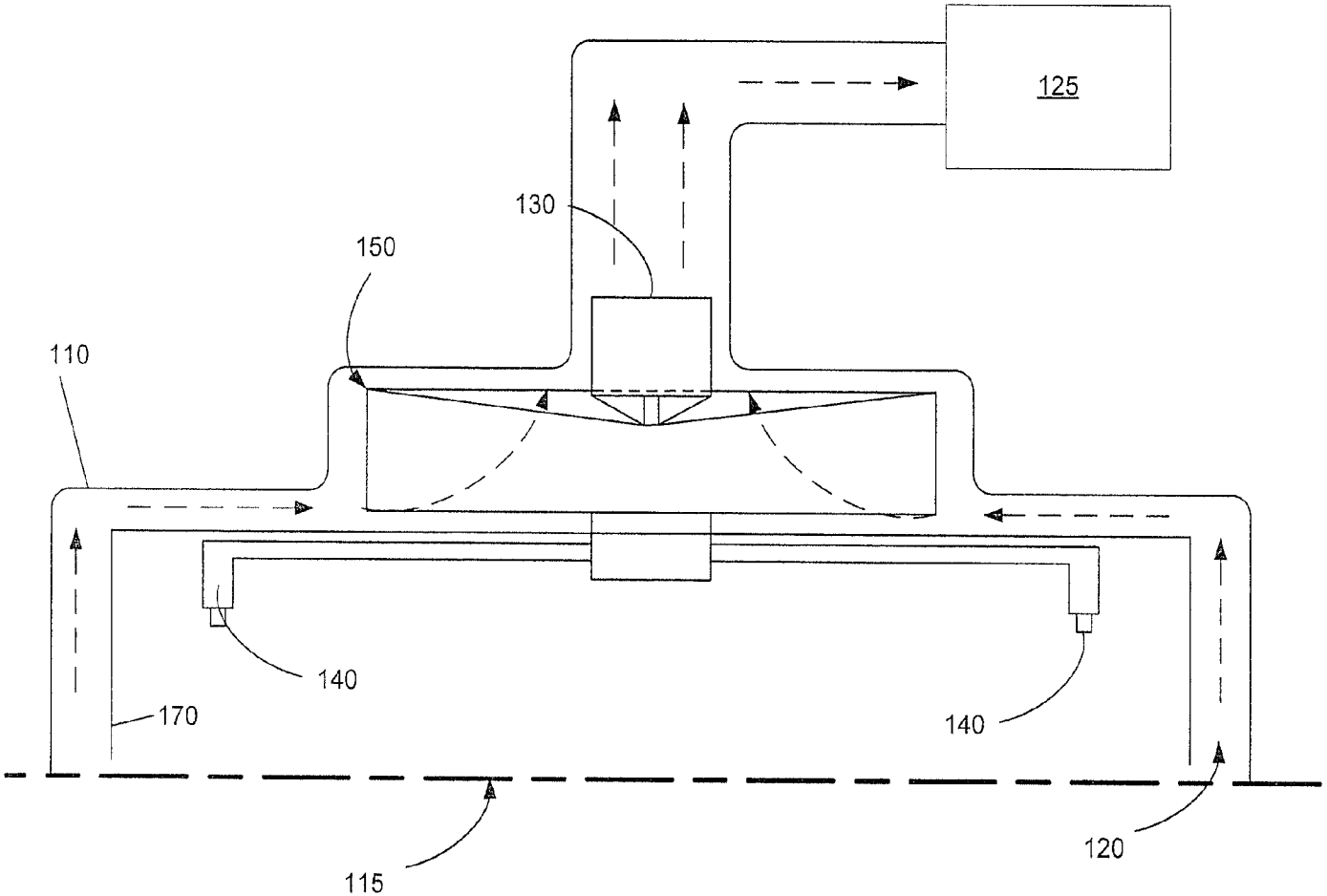
FIG. 5 illustrates a cross sectional view of a solid surface cleaning apparatus configured to drive a turbine with both intake air and dirty water, according to one exemplary embodiment.

Referring now to FIG. 5, according to one exemplary embodiment, a vacuum, positioned above the impeller (150), drives the impeller (150) by inducing air and water through it.

According to this exemplary embodiment, the vacuum acts to draw air as well as soiled water (dashed arrows) from the floor (115), through the vacuum space (120), past the impeller (150), and into the vacuum source (125). As illustrated, according to this embodiment, the impeller (150) is positioned above the inner housing (170). That is, the impeller (150) is placed within the vacuum space (120) leading to the vacuum source (125). As air and soiled water (dashed arrows) pass the impeller (150), the impeller will rotate rapidly, and in turn, rotate the rotating coupler (130). The rotating coupler (130) causes the fluid jets (140) to spin within the inner housing (170). According to this embodiment, similar to previously described embodiments, the fluid jets (140) can be positioned as desired because the rotational drive is not dependent on the high-pressure stream of water emitted by the fluid jets (140).

Therefore, according to various embodiments, a vacuum source may induce air from induction ports (160) or directly pull air and water from the floor (115) to drive an impeller (150). Regardless, the advantage obtained is that the rotational force necessary for effective cleaning is no longer dependent on the fluid jets (140). Thus, the fluid jets (140) may be positioned at angles not possible in the prior art. These angles, such as a negative angle (see FIG. 4A), result in superior cleaning apparatuses.

Figure 6:
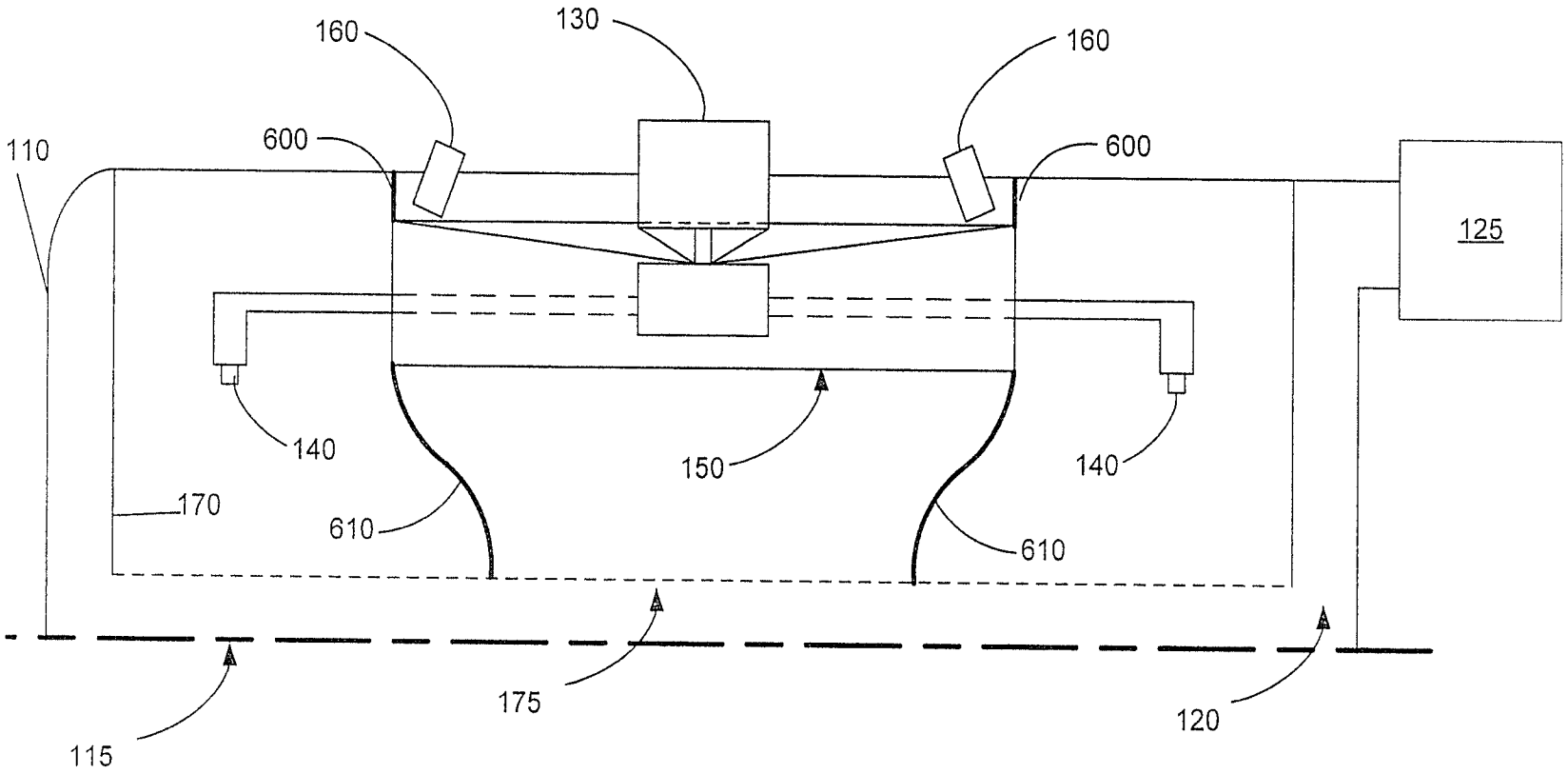
FIG. 6 illustrates a cross sectional view of a solid surface cleaning apparatus with interior baffles positioned to control the flow of air and fluids within the cleaning apparatus, according to one exemplary embodiment.

FIG. 6 illustrates another exemplary embodiment of the present system and method. According to this embodiment, a cleaning apparatus similar to those described in conjunction with FIGS. 1-3, is modified by incorporating a plurality of interior baffles (600, 610) positioned to direct the flow of air and fluids within the cleaning apparatus (100). According to one exemplary embodiment, a top baffle (600) is interposed between the impeller (150) and outer housing (110). Similarly, a lower baffle (610) placed below the impeller (150) directs the flow of incoming air. Additionally, the baffles (600, 610) may be configured to constrict the incoming air as it passes through the impeller (150). The baffles (600, 610) act to concentrate the air and force it through the impeller, thereby generating a greater rotational force.

Both the placement and geometry of the baffles (600, 610) are influenced by a variety of factors. For example, the baffles (600, 610) may be configured to prevent the air stream from disrupting the stream of water emitted from the fluid jets (140). Alternatively or additionally, the interior baffles (600, 610) may direct the air across the floor (115) resulting in increased cleaning efficiency. Moreover, the placement and geometry of the baffles (600, 610) may include positioning the baffles so as to minimally impede the spray from the nozzles (140). According to alternative embodiments, the baffles (600, 610) determine the angle at which the air impacts the floor (115) and are configured to facilitate in cleaning or drying the floor (115).

A variety of alternative geometries are possible; for example, a conic section, a rectangular profile, or a cylinder baffle may be used. Each of these baffle shapes provides a directed air stream that impacts the floor in a different manner. According to various embodiments, the shape of the baffle (600, 610) may be used to manipulate the streams of water emitted from the various fluid jets (140), dry the floor, facilitate in dislodging debris, and/or cause air to guide dislodged debris into the vacuum source (125).

Figure 7:
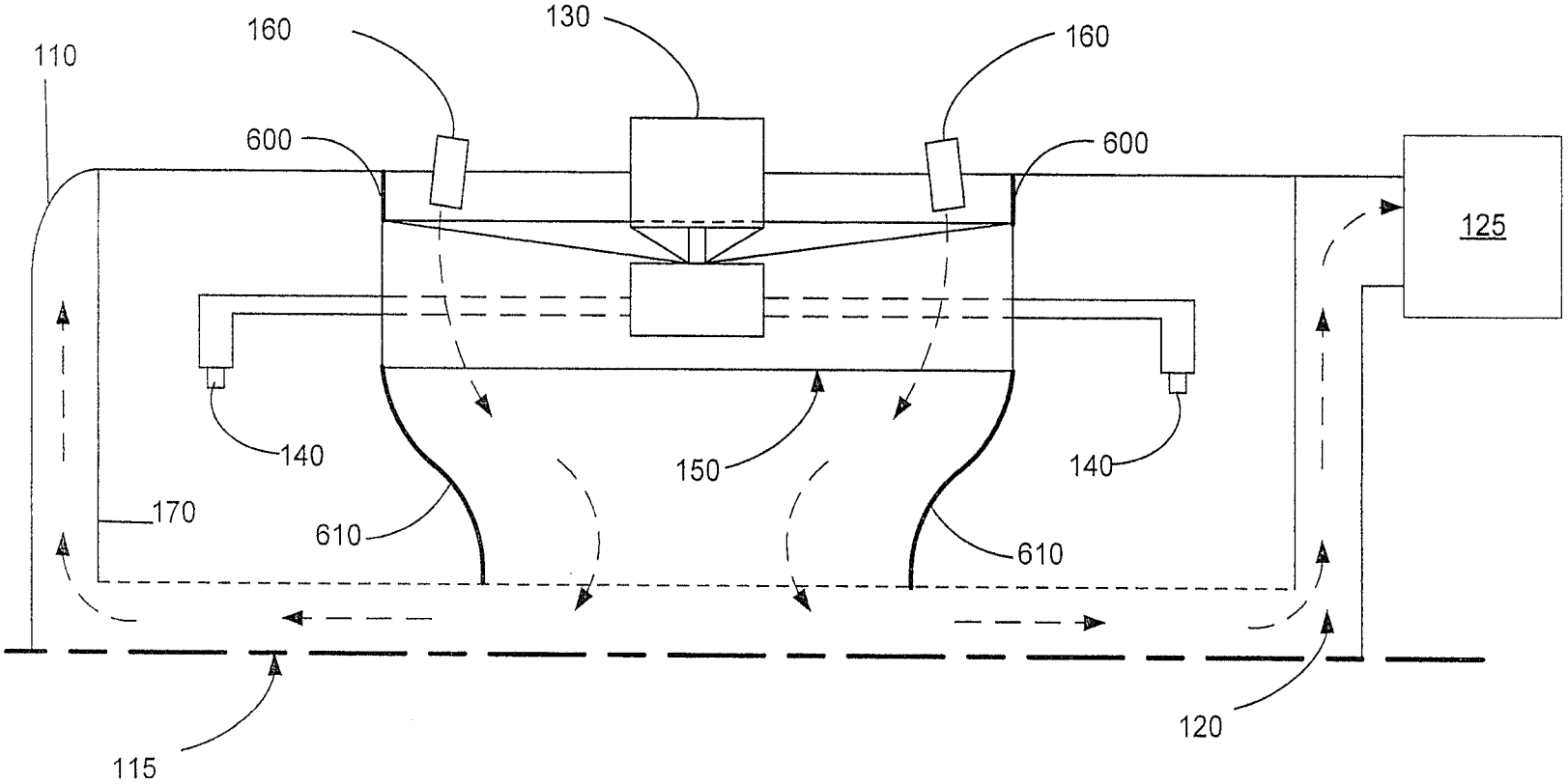
FIG. 7 illustrates a cross sectional view of a solid surface cleaning apparatus with interior baffles and the interior flow or air, according to one exemplary embodiment.

FIG. 7 illustrates a cross sectional side view of an exemplary apparatus (100) with interior baffles (600, 610). An exemplary air stream is illustrated using dashed arrows. According to one exemplary embodiment, the position and angle of the air induction ports (160) can be adjusted to synergistically operate with the interior baffles (600, 610). The incoming air enters the cleaning apparatus (100) through the induction ports (160) and passes through the impeller (150). The outward motion of the air is at least partially restricted by the baffles (600, 610). The air stream is then concentrated into the center of the cleaning apparatus (100) where cleaning solution and particulate matter accumulates. By ramming the incoming air into the central portion of the floor covered by the cleaning apparatus (100) the excess cleaning solution and particulate matter is moved from center of the apparatus to the perimeter, where it can be entrained in the air stream moving through the vacuum space (120) and finally, into the vacuum source (125). As previously described, according to one exemplary embodiment, the strong motion of air parallel to the surface of the floor (115) beneath the cleaning apparatus (100) creates additional cleaning action as it interacts with the spray released from the fluid jets (140). Additionally, similar baffles may be incorporated into the various embodiments of the apparatus described in conjunction with FIG. 5.

In conclusion, according to one exemplary embodiment, the cleaning apparatus utilizes induced air to drive the rotation of a rotating coupler, thereby imparting a rotational force on the fluid jet assembly. According to one exemplary embodiment, the present exemplary systems and methods allow for a more perpendicular fluid jet angle and improved surface cleaning at lower speeds. This is accomplished by incorporating a leading edge of spray in the direction of rotation. That is, the water stream is at a negative angle relative to the direction of rotation. Furthermore, because the required rotation is not dependent on the high-pressure emitted from the fluid jets, the apparatus can be used at low water pressures while maintaining high rotational speeds.

The preceding description has been presented only to illustrate and describe the present method and system. It is not intended to be exhaustive or to limit the present system and method to any precise form disclosed. Many modifications and variations are possible in light of the above teaching.

The foregoing embodiments were chosen and described in order to illustrate principles of the system and method as well as some practical applications. The preceding description enables others skilled in the art to utilize the method and system in various embodiments and with various modifications, as are suited to the particular use contemplated. It is intended that the scope of the present exemplary system and method be defined by the following claims.

What is claimed is:

1. An apparatus for cleaning surfaces, comprising:

a housing having at least one air induction port traversing the housing;

a rotating coupler;

an impeller coupled to the rotating coupler;

at least one fluid jet coupled to the rotating coupler;

wherein rotation of the impeller by a flow of air through the at least one air induction port causes the rotating coupler and the at least one fluid jet to rotate; and wherein a baffle carried by and rotatable with the impeller and extending circumferentially around a rotation volume of the impeller, the baffle being positioned to further direct the flow of air to said impeller.

2. An apparatus for cleaning a surface, comprising:

a housing:

a rotating coupler coupled to the housing;

an impeller coupled to the rotating coupler and positioned in the housing;

an air induction port positioned in the housing and above the impeller, to direct a flow of air to the impeller and cause the impeller to rotate;

a liquid jet coupled to the rotating coupler and the impeller; and a baffle carried by and rotatable with the impeller, the baffle extending circumferentially around a rotation volume of the impeller, the baffle being positioned to further direct the flow of air to the impeller.

3. The apparatus of claim 2, wherein the housing includes a vacuum port coupleable to a vacuum source.

4. The apparatus of claim 2, wherein the liquid jet is oriented to form an angle between 80 and 90 degrees relative to a plane in which the impeller rotates.

5. The apparatus of claim 2, wherein the baffle is an upper baffle, and wherein the apparatus further comprises:

a lower baffle carried by and rotatable with the impeller to further direct the flow of air toward a lower portion of the housing.

6. The apparatus of claim 5, wherein the lower baffle is positioned to direct the flow of air to form an airflow parallel to a plane in which the impeller rotates.

7. The apparatus of claim 2, wherein the baffle is positioned to separate the flow of air from a liquid stream emitted from the liquid jet.

8. The apparatus of claim 2, wherein the impeller includes a plurality of blades circumferentially positioned adjacent to the air induction port.

9. An apparatus for cleaning a surface with a cleaning solution, the apparatus comprising:

a housing having a vacuum port;

an air induction port positioned in the housing;

an impeller rotatably positioned below the air induction port;

a fluid jet coupled to the impeller to rotate with the impeller and positioned to dispense the cleaning solution on the surface;

an upper baffle carried by and rotatable with the impeller and extending circumferentially around a rotation volume of the impeller, wherein the upper baffle is positioned to guide a flow of air through the air induction port to the impeller; and a lower baffle carried by and rotatable with the impeller to further direct the flow of air.

10. The apparatus of claim 9, further comprising:

an inner housing positioned to separate the fluid jet and the impeller from the vacuum port.

11. The apparatus of claim 9, wherein the lower baffle is positioned in a lower portion of the housing.

12. The apparatus of claim 9, wherein the lower baffle is positioned to direct the flow of air through the air induction port to form an airflow parallel to a plane in which the impeller rotates.

13. The apparatus of claim 12, wherein the housing has an upper portion and a lower portion, and wherein the airflow parallel to the plane is formed in the lower portion of the housing.

14. The apparatus of claim 9, wherein the fluid jet is positioned between the upper baffle and the lower baffle.

15. The apparatus of claim 9, wherein the lower baffle includes a portion parallel to a plane in which the impeller rotates.

16. The apparatus of claim 9, wherein the impeller is positioned between the upper baffle and the lower baffle.

17. A method for manufacturing a surface cleaner, comprising:

forming an air induction port in a housing;

forming a vacuum port in the housing, wherein the vacuum port is coupleable to a vacuum source;

coupling rotating coupler to the housing;

positioning an impeller inside the housing, wherein the impeller includes a plurality of blades;

coupling the impeller to the rotating coupler, wherein at least one of the plurality of blades is positioned adjacent to the air induction port;

coupling a fluid jet to the rotating coupler, wherein the rotating coupler is coupleable to a fluid source; and connecting a baffle to the impeller, wherein the baffle extends circumferentially around a rotation volume of the impeller and is positioned to direct a flow of air through the air induction port to the impeller.

18. The method of claim 17, wherein the baffle is an upper baffle, and wherein the method further comprises:

connecting a lower baffle to the impeller.

19. The method of claim 18, further comprising:

positioning the lower baffle in a lower portion of the housing so as to direct the flow of air to form an airflow parallel to a plane in which the impeller rotates in the lower portion of the housing.

20. The method of claim 17, further comprising:

orienting the fluid jet to form an angle between 80 and 90 degrees relative to a plane in which the impeller rotates.

21. The method of claim 17, further comprising:

positioning the plurality of blades of the impeller;

positioning a lower baffle in a lower portion of the housing so as to form an airflow parallel to a plane in which the impeller rotates; and orienting the fluid jet to form an angle relative to the plane.

* * * * *

UNITED STATES PATENT AND TRADEMARK OFFICE

CERTIFICATE OF CORRECTION

PATENT NO. : 9,066,647 B2
APPLICATION NO. : 13/971718
DATED : June 30, 2015
INVENTOR(S) : Paul Kappos It is certified that error appears in the above-identified patent and that said Letters Patent is hereby corrected as shown below:

In the claims

In column 8, line 64, in claim 2, delete "housing:" and insert -- housing; --, therefor.

Signed and Sealed this
Twenty-fourth Day of November, 2015

Michelle K. Lee

Michelle K. Lee
*Director of the United States Patent and Trademark Office*